US005872851A

United States Patent [19]

Petroff

[11] Patent Number: 5,872,851

[45] Date of Patent: Feb. 16, 1999

[54] DYNAMIC STEREOPHONIC ENCHANCEMENT SIGNAL PROCESSING SYSTEM

[75] Inventor: Michael L. Petroff, West Hills, Calif.

[73] Assignee: Harman Motive Incorporated, Martinsville, Ind.

[21] Appl. No.: 858,554

[22] Filed: May 19, 1997

Related U.S. Application Data

[60] Provisional application No. 60/017,975 May 20, 1996.

[51] Int. Cl.[6] ..... H04R 5/00

[52] U.S. Cl. ..... 381/18; 381/17; 381/1; 381/22

[58] Field of Search ..... 381/1, 17, 18, 381/19, 20, 21, 22, 23, 63

[56] References Cited

U.S. PATENT DOCUMENTS

| | | | |
|---|---|---|---|
| 4,908,858 | 3/1990 | Ohno | 381/17 |
| 4,933,786 | 6/1990 | Ishikawa et al. | 381/17 |
| 5,210,796 | 5/1993 | Hirabayashi et al. | 381/22 |
| 5,216,718 | 6/1993 | Fukuda | 381/19 |
| 5,333,201 | 7/1994 | Waller, Jr. | 381/22 |
| 5,412,731 | 5/1995 | Desper | 381/1 |
| 5,524,053 | 6/1996 | Iwamatsu | 381/17 |
| 5,572,591 | 11/1996 | Numazu et al. | 381/17 |
| 5,592,558 | 1/1997 | Stuhlfelner et al. | 381/17 |
| 5,638,452 | 6/1997 | Waller, Jr. | 381/22 |
| 5,657,391 | 8/1997 | Jyosako | 381/1 |
| 5,680,464 | 10/1997 | Iwamatsu | 381/18 |

FOREIGN PATENT DOCUMENTS

| | | | |
|---|---|---|---|
| 1175362 | 10/1984 | Canada | 381/1 |
| 0517233 | 12/1992 | European Pat. Off. | 381/17 |
| 5-199599 | 8/1993 | Japan | 381/17 |

*Primary Examiner*—Curtis A. Kuntz
*Assistant Examiner*—Xu Mei
*Attorney, Agent, or Firm*—J. E. McTaggart

[57] ABSTRACT

A stereophonic signal processing system for enhancing the perception of sonic dimension and imaging in a sound reproduction system having at least two stereo speakers. The system provides a detector for detecting the continually changing value of amplitude ratio of a derived stereo difference signal relative to a derived stereo sum signal and dynamically expands, in real-time, changes in such ratio-value in the left-front and right-front output signals; an element for utilizing the ratio-value to control a decrease in the amplitudes of the front-left and front-right output signals; an element for utilizing the ratio-value to control a boost in the relative amplitude of bass frequencies in the left-front and right-front output signals and a boost in the amplitude of a subwoofer output signal; an element for utilizing the ratio-value to control a boost in amplitude of derived stereo difference signals that provide left-rear and right-rear output signals; and an element for utilizing the derived stereo sum signal to provide a center-front output signal.

19 Claims, 3 Drawing Sheets

FIG. 1A
PRIOR ART
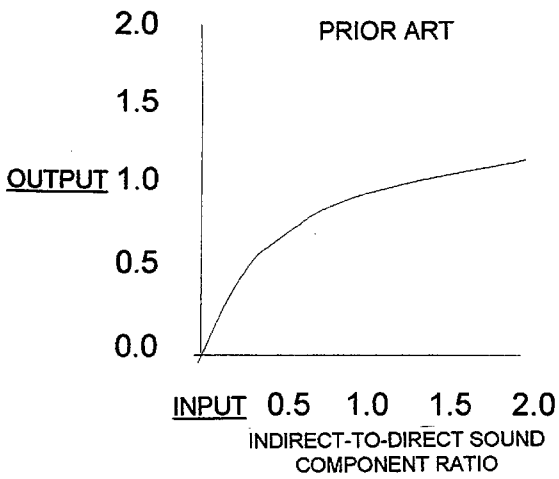
FIG. 1B
PRIOR ART
FIG. 1C
FIG. 1D
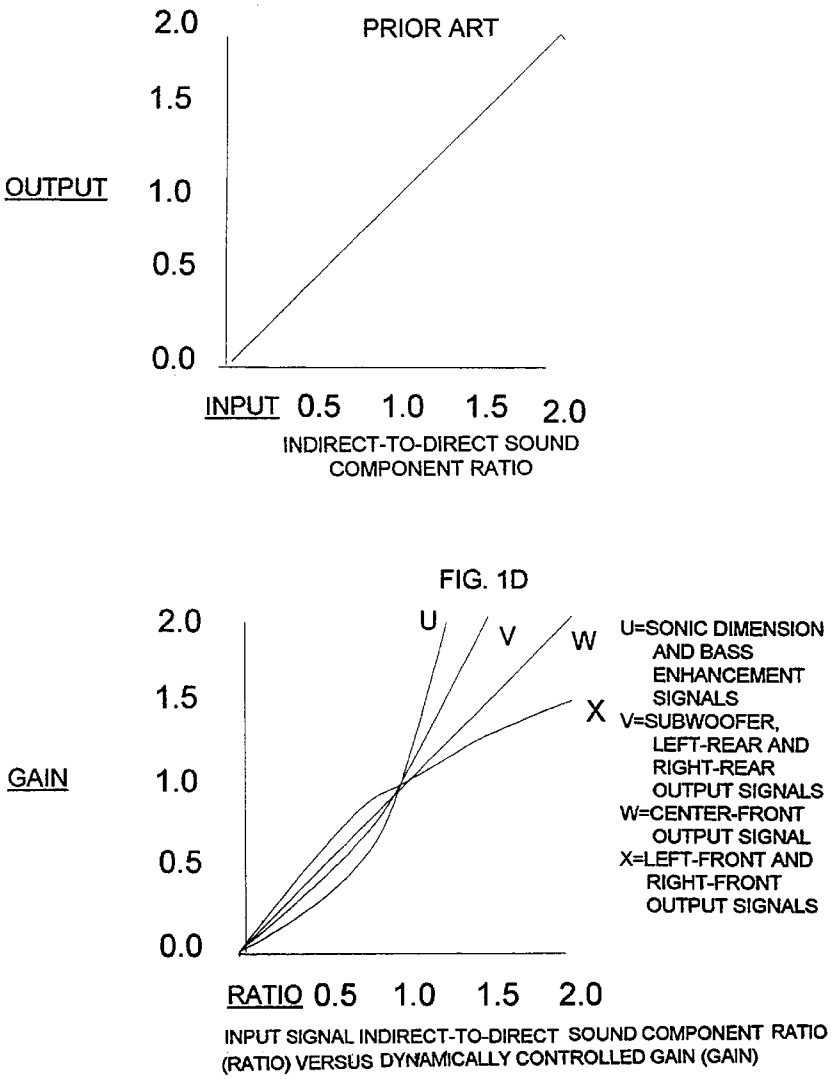

DYNAMIC STEREOPHONIC ENCHANCEMENT SIGNAL PROCESSING SYSTEM

BENEFIT OF PROVISIONAL APPLICATION

Benefit is claimed under 35 U.S.C, §119(e) of pending provisional application #60/017,975 filed May 20, 1996.

FIELD OF THE INVENTION

This invention relates to stereophonic sound reproduction and more specifically to audio signal processing circuitry for enhancing sonic dimension and stereophonic imaging produced by a sound reproduction system having at least two stereophonic speakers.

BACKGROUND OF THE INVENTION

It is known that stereophonic recordings are most commonly implemented using a multiplicity of microphones each placed in the near-field of one or more musical instruments, and when the recordings are reproduced by conventional stereophonic sound systems comprising two stereo speakers, the perceived sound stage is substantially limited to the physical space separating the stereo speakers. Several signal processing systems have been devised to enhance the perceived size, or sonic dimension, of the reproduced sound stage, each having specific performance limitations. Signal processing systems have been developed employing crosstalk cancellation, in which a time-delayed, filtered and attenuated left stereo signal is mixed with the right stereo signal, and a time-delayed, filtered and attenuated right stereo signal is mixed with the left stereo signal, thereby enabling, under ideal conditions, the cancellation of acoustic crosstalk occurring from the left stereo speaker to the right ear of a listener and from the right stereo speaker to the left ear of the listener. While the above crosstalk cancellation systems provide an enhancement of sonic dimension, th extent of the enhancement is restricted with stereophonic, non-binaural recordings and requires that the listener remains precisely equidistant between the stereo speakers for proper crosstalk cancellation. Other signal processing systems have been devised employing difference signal enhancement, in which a derived L-R stereo difference signal is filtered, attenuated and mixed with the left stereo signal, and a derived R-L stereo difference signal is filtered, attenuated and mixed with the right stereo signal, resulting in an increase in the relative level of indirect sound components. Such systems provide an enhancement of sonic dimension, however the dimensional enhancement is invariably gained at the expense of a corresponding degradation in the imaging and focus of center-mixed musical instruments recorded with substantially equal amplitude on the left and right channels.

Variations of such difference signal enhancement systems incorporate means to dynamically compress, in real time, changes in the ratio of amplitude of the derived stereo difference signal relative to the unmodified stereo signals, thereby dynamically compressing changes in the ratio of indirect-to-direct sound components. Another variation of such difference signal enhancement systems incorporates a means to detect frequency bands of such difference signals that are relatively low in amplitude and selectively amplify such difference signal frequency bands, thereby providing a more complex method for dynamically compressing changes in the ratio of indirect-to-direct sound components. Enhancement systems providing dynamic compression of such ratio, however, exacerbate the above described degradation in the imaging and focus of center-mixed instruments for reasons later explained in the present invention.

An analysis of the characteristics of signal components created in stereophonic recordings indicates that a difference signal enhancement system, in which a dynamic expansion, rather than a dynamic compression, of changes in the ratio of indirect-to-direct sound components yields substantially greater sonic dimension relative to the above described prior art without degradation of they imaging and focus of center-mixed instruments. The expansion of changes in such ratio represents a diametrically opposite approach to that of any difference signal enhancement system known to this inventor in which such ratio is dynamically modified, and forms the functional basis of the present invention.

Empirical tests conducted by this inventor confirm that when an instrument is monitored by a microphone in the near-field, providing a low ratio of indirect-to-direct sound components, is center-mixed and dominant in amplitude (which conditions typically occur with single lead instruments and vocals), the nature of psychoacoustics is such that the listener anticipates the perception of a near-field reproduction of such instrument in the form of a convergent image located between the stereo speakers. Such conditions are optimally satisfied by a low level of difference signal enhancement, since a high level of difference signal enhancement would alter the reproduced near-field characteristics to those resembling far-field characteristics and thereby degrade the desired perception of a center image. Conversely, when instruments are recorded with reverberation to emulate monitoring by a microphone in the far-field, providing a higher ratio of indirect-to-direct sound components, or when instruments are mixed asymmetrically between the left and right channels (which conditions typically occur with groups of non-dominant instruments and vocals), the listener anticipates the perception of a far-field reproduction of such instruments in the form of a divergent image expanding beyond the physical space separating the stereo speakers. Such conditions are optimally satisfied by a high level of difference signal enhancement providing a reinforcement of far-field reverberant information and a divergent, non-specific image.

It follows from the above that a real-time expansion of changes in the ratio of indirect-to-direct sound components optimizes both the sonic dimension and imaging qualities of the reproduced stereophonic sound. Therefore, a feature of the present invention is a means for detecting the continually changing value of amplitude ratio of a derived stereo difference signal relative to a derived stereo sum signal, which correlates to the ratio of indirect-to-direct sound components, and a means for dynamically expanding, in real-time, changes in such ratio in the left-front and right-front output signals.

A characteristic of all difference signal enhancement processors known to this inventor is an inherent functionality of increasing input-to-output gain corresponding to increasing values of amplitude ratio of a derived stereo difference signal relative to a derived stereo sum signal. Therefore, an additional feature of the present invention is a means for utilizing such ratio-value to control a reduction in amplitude of the front-left and front-right output signals.

A second characteristic of all difference signal enhancement processes known to this inventor is a functionality of decreasing relative amplitude of bass frequencies in the processed output signals corresponding to increasing values of amplitude ratio of a derived stereo difference signal relative to a derived stereo sum signal. Therefore, yet another feature of the present invention is a means for utilizing such ratio-value to control a boost in the relative amplitude of bass frequencies in the left-front and right-front output signals; and, for the same reason, still another feature of the present invention is a means for utilizing the ratio-value to control a boost in amplitude of a derived L+R sum signal applied to a low-pass filter that generates a subwoofer output signal.

A further feature of the present invention is a means for utilizing the ratio-value to control a boost in amplitude of the derived L-R stereo difference signal that generates a left-rear output signal; and, a means for utilizing the ratio-value to control a boost in amplitude of the derived R-L stereo difference signal that generates a right-rear output signal.

An enhancement system incorporating at least one of the above described features of the present invention would be equally effective utilized in the recording process to apply its associated signal processes to the recorded information, as it would be in the playback process to apply such processes to unmodified recorded stereophonic signals.

OBJECTS OF THE INVENTIONS

A primary object of the present invention is to provide a means for real-time expansion of changes in the ratio of indirect-to-direct sound components comprised in stereo source signals.

An object of the present invention is to provide a means for detecting the continually changing value of amplitude ratio of a derived stereo difference signal relative to a derived stereo sum signal and dynamically expanding, in real-time, changes in such ratio in the left-front and right-front output signals.

An additional object of the present invention is to provide a means for utilizing the ratio-value to control a reduction in amplitude of the front-left and front-right output signals.

Another a object of the present invention is to provide a means for utilizing the ratio-value to control a boost in the relative amplitude of bass frequencies in the left-front and right-front output signals.

A Still another object of the present invention is to provide a means for utilizing the ratio-value to control a boost in the amplitude of a low-pass filtered stereo sum signal, thereby generating a subwoofer output signal.

Yet another object of the present invention is to provide a means for utilizing the ratio-value to control a boost in amplitude of a derived L-R stereo difference signal component, thereby generating a rear-left output: signal; and, a means for utilizing the ratio-value to control a boost in amplitude of a derived R-L stereo difference signal component, thereby generating a right-rear output signal.

A further object of the present invention is to provide a means for utilizing the derived stereo sum signal to generate a center-front output signal.

SUMMARY OF THE INVENTION

The present invention is a stereophonic signal processing system that provides a means for detecting the continually changing value of amplitude ratio of a derived stereo difference signal relative to a derived stereo sum signal and dynamically expands, in real-time, changes in such ratio in the left-front and right-front output signals; a means for utilizing the ratio-value to control a decrease in the amplitudes of the front-left and front-right output signals; a means for utilizing the ratio-value to control a boost in the relative amplitude of bass frequencies in the left-front and right-front output signals and a boost in the amplitude of a subwoofer output signal; a means for utilizing the ratio-value to control a boost in amplitude of derived stereo difference signals that generate left-rear and right-rear output signals; and a means for utilizing such derived stereo sum signal to provide a center-front output signal.

BRIEF DESCRIPTION OF THE DRAWINGS

The objects and advantages of the present invention will be more fully understood from the following description taken with the accompanying drawings in which:

FIGS. 1A–1B are graphs which, to the best of this inventor's understanding, approximate the input versus output relationship of the indirect-to-direct sound component ratios of two prior art difference signal enhancer processes.

FIG. 1C is a graph which approximates the input versus left-front output and input versus right-front output relationship of the indirect-to-direct sound component ratio of the present invention.

FIG. 1D is a graph approximating the indirect-to-direct sound component ratio of the stereo input signals versus the dynamically controlled gains of four signals comprised in the present invention.

DETAILED DESCRIPTION OF THE DRAWINGS

With reference to the drawings, where like alpha-numeric designations refer to like alpha-numeric designations in every drawing, FIG. 1A is a graph which, to the best of this inventor's understanding, approximates the input versus output relationship of the indirect-to-direct sound component ratio of a prior art difference signal enhancer process as described by U.S. Pat. No. 5412731, in which a means is provided to dynamically compress, in real time, changes in the ratio of amplitude of a derived stereo difference signal relative to unmodified stereo signals.

FIG. 1B is a graph which, to the best of this inventor's understanding, approximates the input versus output relationship of the indirect-to-direct sound component ratio of a prior art difference signal enhancer process as described by U.S. Pat. No. 4,815,133, in which a means is provided to increase, by a fixed non-dynamic amount, the ratio of amplitude of a derived stereo difference signal relative to unmodified stereo input signals.

FIG. 1C is a graph which approximates the input versus left-front output and input versus right-front output relationship of the indirect-to-direct sound component ratio of the present invention, in which a means is provided to dynamically expand, in real time, changes in the ratio of amplitude of the derived stereo difference signal relative to the unmodified stereo signals.

FIG. 1D is a graph representing the input signal indirect-to-direct sound components versus the dynamically-controlled gains of stereo difference signals S16 and S22, which serve to provide sonic dimension and image enhancement: of the left and right stereo input signals respectively, and of stereo sum signal S18, which serves to provide bass enhancement of the left and right stereo input signals, each of which dynamically-controlled gains are depicted by curve U; the dynamically-controlled gains of signal S17, which serves as the subwoofer output signal, and of signals S15 and S21, which serve as the left-rear and right-rear output signals respectively, each of which dynamically-controlled gains are depicted by curve V; the dynamically-controlled gain of signal S4, which serves as the center-front output signal, which dynamically-controlled gain is depicted by curve W; and, the dynamically-controlled gains of signals S19 and S20, which serve as the left-front and right-front output signals respectively, which dynamically-controlled gains are depicted by curve X.

Figure 2:
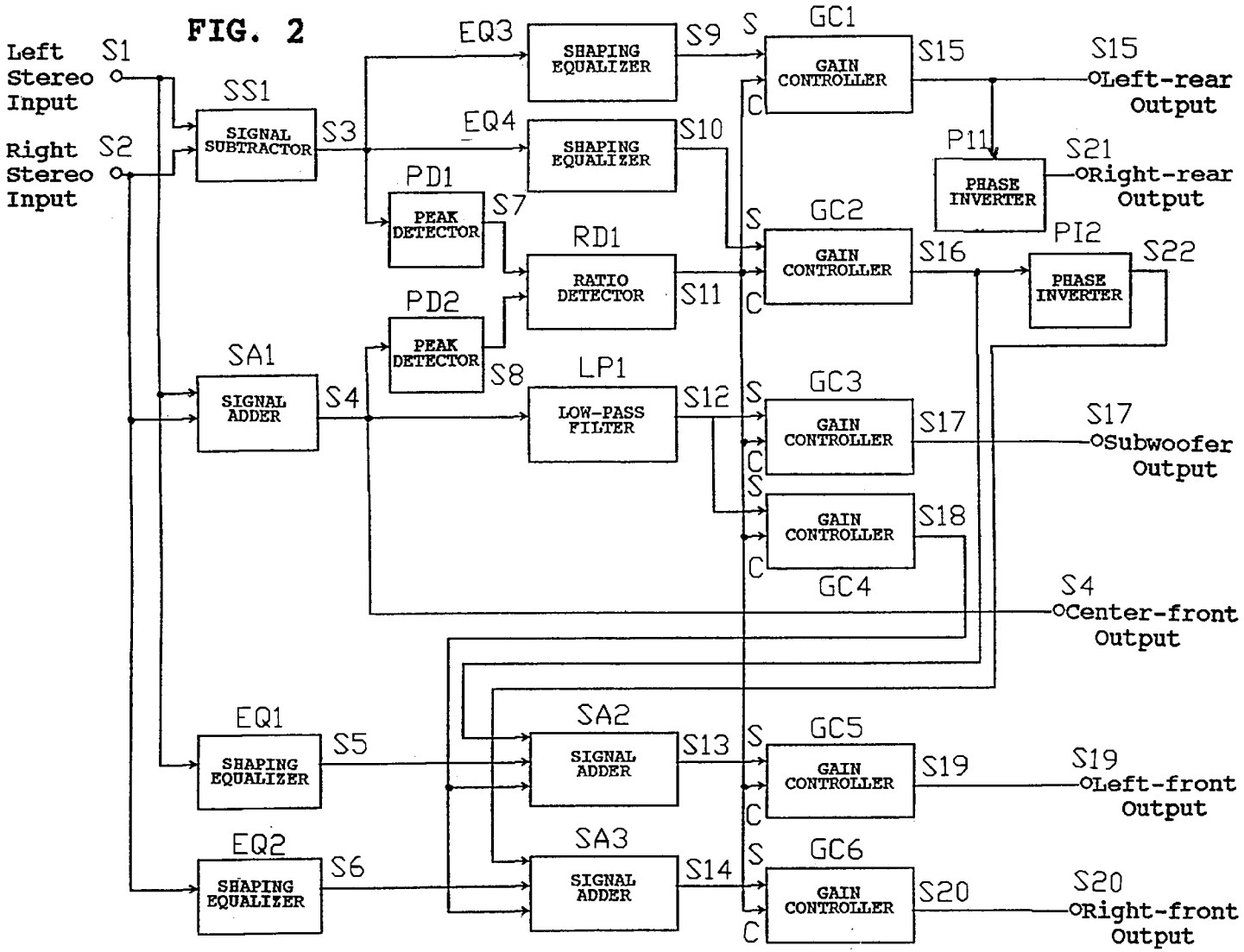
FIG. 2 is a block diagram illustrating the preferred embodiment of a signal processing system designed in accordance with the present invention.

FIG. 2 is a block diagram illustrating the preferred embodiment of a stereophonic signal processing system which has as inputs right stereo signal S1 and left stereo signal S2. Signals S1 and S2 are applied to the input of Signal Subtractor SS1, which derives a stereo difference output signal S3 equal to S1–S2.

Signal S3 is applied to the input of Peak Detector PD1, which provides a DC output signal S7 proportional to the peak value of stereo difference signal S3.

Signals S1 and S2 are applied to the input of Signal Adder SA1, which derives a stereo sum output signal S4 equal to S1+S2. Signal S4 serves as the center-front output signal.

Signal S4 is applied to the input of Peak Detector PD2, which provides a DC output signal S8 proportional to the peak value of stereo sum signal S4.

Signal S1 is applied to Shaping Equalizer EQ1, which provides an output signal S5 in which high frequencies are boosted to compensate for the commonly subjective lower high frequency presence of center-mixed components comprised in stereophonic signals. Signal S2 is applied to Shaping Equalizer EQ2, which provides an output signal S6 in which high frequencies are boosted to compensate for the commonly subjective lower high frequency presence of center-mixed components comprised in stereophonic signals Signals S7 and S8 are applied to the input of Ratio Detector RD1, which provides a DC ratio-value output signal S11 equal to S7/S8, which is proportional to the ratio of a derived stereo difference signal S7 relative to a derived stereo sum signal S8.

Signal S11 is applied to the gain-control inputs, each labeled c, of Gain Controllers GC1, GC2, GC3, GC4, GC5 and GC6.

Stereo difference signal S3 is applied to the input of Shaping Equalizer EQ3, which provides an output signal S9 in which frequencies above a pre-determined mid-band region are progressively attenuated to a first maximum attenuation value.

Signal S9 is applied to the signal input. labeled s, of Gain Controller GC1, which provides a first equalized and dynamically-controlled stereo difference output signal S15 equal to dS11×S9, where "d" is a coefficient equal to less than one. Signal S15 serves as the left-rear output signal.

Signal S15 is applied to the input of Phase Inverter PI1, which provides a second equalized and dynamically-controlled stereo difference output signal S21 equal to 1/S15. Signal S21 serves as the right-rear output signal.

Stereo difference signal S3 is applied to the input of Shaping Equalizer EQ4, which provides an output signal S10 in which frequencies above a pre-determined mid-band region are progressively attenuated to a second maximum attenuation value.

Signal S10 is applied to the signal input, labeled "s", of Gain Controller GC2, which provides a third equalized and dynamically-controlled stereo difference output signal S16 equal to S11×S10. Signal S16 serves to provide sonic dimension and image enhancement of the left stereo input signal in subsequently described signal processes. Signal S16 is applied to the input of Phase Inverter pi, which provides a fourth equalized and dynamically-controlled stereo difference output signal S22 equal to 1/S16. Signal S22 serves to provide sonic dimension and image enhancement of the right stereo input signal in subsequently described signal processes.

Signal S4 is applied to Low-Pass Filter LP1, which provides a filtered stereo sum output signal S12 having a pre-determined roll-off frequency.

Signal S12 is applied to the signal input, labeled "s", of Gain Controller GC3, which provides a first filtered and dynamically-controlled stereo sum output signal S17 equal to eS11×S12, where "e" is a coefficient equal to less than one. Signal S17 serves as the subwoofer output signal.

Signal S12 is applied to the signal input, labeled "s", of Gain Controller GC4, which provides a second filtered and dynamically-controlled stereo sum output signal S18 equal to S11×S12. Signal S18 serves to provide bass enhancement of the left and right stereo input signals in subsequently described signal processes.

Signals S5, S16 and S18 are applied to the input of Signal Adder SA2, which provides an enhanced left stereo output signal S13 equal to S1+S16+S18 in which S5 contributes an equalized left stereo input signal, B16 contributes an equalized and gain-controlled stereo difference signal thereby providing sonic dimension and image enhancement of signal S5, and S18 contributes a filtered and gain-controlled stereo sum signal thereby providing bass enhancement of signal S5.

Signal S13 is applied to the signal input, labeled s, of Gain Controller GC5, which provides an enhanced left stereo output signal S19 equal to –fS11×S13, where "f" is a coefficient equal to less than one and the minus sign indicates an inverse relationship between the DC control input signal level and the output signal amplitude of GC5. Signal S19 serves as the left-front output signal.

Signals S6, S22 and S18 are applied to the input of Signal Adder SA3, which provides an enhanced right stereo output signal S14 equal to S2+S22+S18 in which S5 contributes an equalized right stereo input signal, S22 contributes an equalized and gain-controlled stereo difference signal (having a phase opposite that of Signal S16) thereby providing sonic dimension and image enhancement of signal S6, and S18 contributes a filtered and gain-controlled stereo sum signal thereby providing bass enhancement of signal S6.

Signal S14 is applied to the signal input, labeled s, of Gain Controller GC6, which provides an enhanced right stereo output signal S20 equal to –gS11×S14, where "g" is a coefficient equal to less than one and the minus sign indicates an inverse relationship between the DC control input signal level and the output signal amplitude of GC6. Signal S20 serves as the right-front output signal.

The left and right stereo input signals, the left-front and right-front output signals, and the left-rear and right-rear output signals may each be interposed simultaneously without effecting the functionality or performance of the above described signal processes. Additionally, equivalent methods of implementing the above described signal processes including but not limited to equivalent DSP, would by definition each comprise equivalent principles and concepts disclosed in the present invention.

Figure 3:
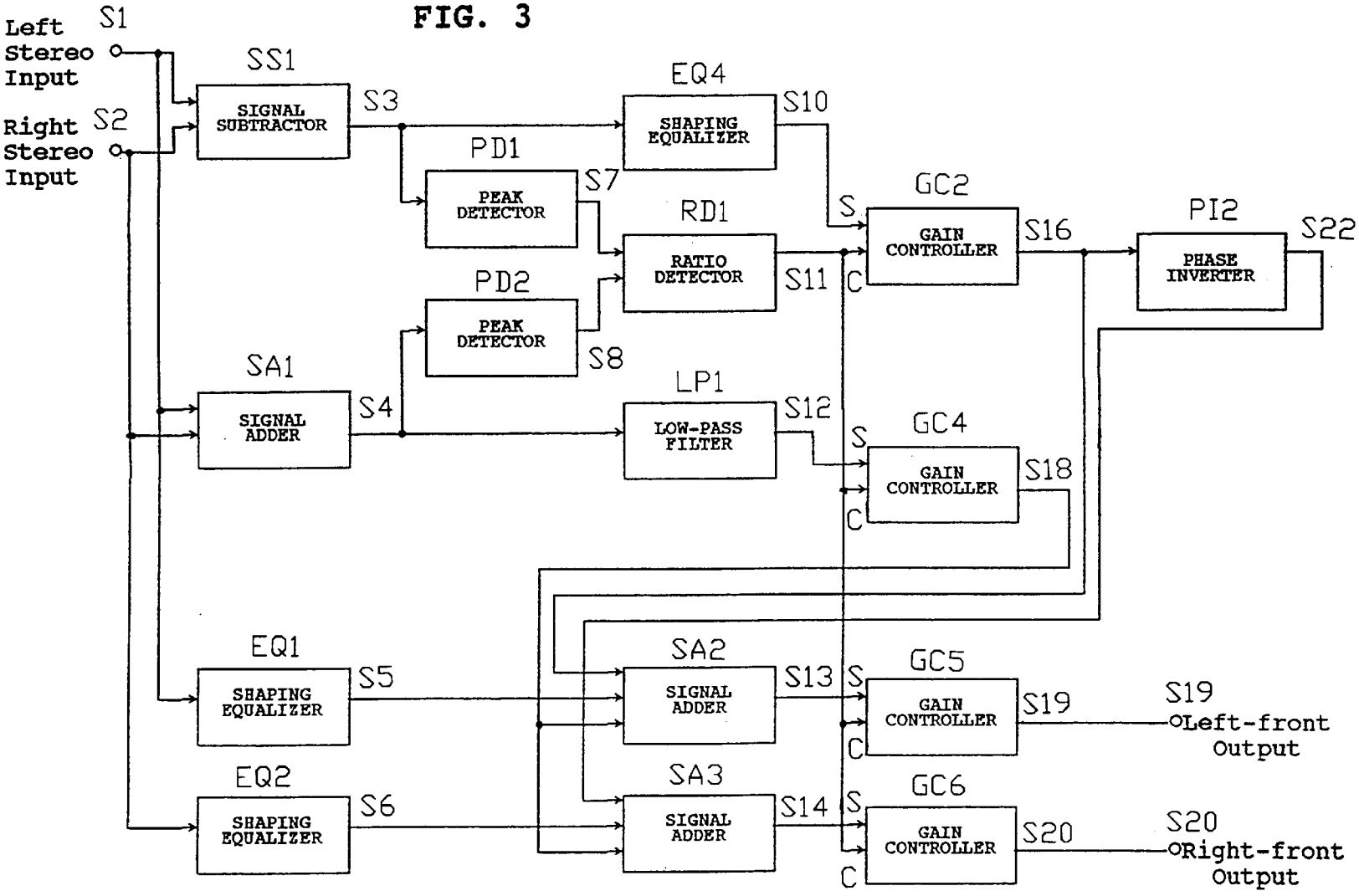
FIG. 3 is a block diagram illustrating a modified and simplified form of the stereophonic signal processing system of FIG. 2.

FIG. 3 is a block diagram illustrating a modified and simplified form of the stereophonic signal processing system of FIG. 2, in which all elements having like alpha-numeric designations in FIG. 3 are identical to all elements having like alpha-numeric designations in FIG. 2, and in which all sections required to generate the left-rear, right-rear and subwoofer output signals, comprising sections EQ3, GC1, GC3 and PI1, are eliminated and signal S4 does not serve as the center-front output signal, without affecting the functionality and performance of the above described signal processes as they apply to the left-front and right-front output signals for two-speaker stereophonic applications.

The invention can also be practiced in several alternative combinations implementing further refinements in the embodiment of FIG. 3 by the addition of selected ones of the functional circuit blocks shown in FIG. 2.

Furthermore, the invention can also be practiced with even further simplification relative to the FIG. 3 embodiment: for example, gain controllers GC5 and GC6 could be eliminated; similarly, the invention can be practiced in a basic form with low frequency optimization omitted by eliminating low-pass filter LP1 and gain controller GC4, and eliminating or disabling the third input node in each of the signal adders SA2 and SA3, shown in FIG. 3 as the lowermost input node of each signal adder, receiving signal 818 from gain controller GC4.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A stereo enhancement signal processor, for incorporation into a stereo sound system that provides a stereo signal pair from a stereo source and a stereophonic amplifier, receiving a pair of stereo line-level input signals and driving stereo loudspeakers, said signal processor, implemented by electronic circuitry, comprising:

a signal subtractor, receiving as input the stereo signal pair, configured and arranged to provide as output a difference signal;

a first signal adder, receiving as two inputs the stereo signal pair, configured and arranged to provide as output a sum signal;

a first shaping equalizer, receiving as input a first signal of the stereo signal pair, configured and arranged to provide as output an equalizer-shaped first stereo signal;

a second shaping equalizer, receiving as input a second signal of the stereo signal pair, configured and arranged to provide as output an equalizer-shaped second stereo signal;

a first peak detector, receiving as input the difference signal, configured and arranged to provide as output a peak-detected DC difference signal;

a second peak detector, receiving as input the sum signal, configured and arranged to provide as output a peak-detected DC sum signal;

a ratio detector, receiving as inputs the peak-detected DC difference signal and the peak-detected DC sum signal, configured and arranged to provide as output a DC ratio-value signal representing an amplitude ratio between the inputs;

a third shaping equalizer, receiving as input the difference signal, configured and arranged to provide as output an equalizer-shaped difference signal;

first gain controller, receiving as a signal input the equalizer-shaped difference signal and receiving as a control input the DC ratio-value signal, configured and arranged to provide as output a dynamic-gain-controlled equalizer-shaped difference signal;

a first phase inverter, receiving as input the dynamic-gain-controlled equalizer-shaped difference signal, configured and arranged to invert the received input and provide therefrom an inverted dynamic-gain-controlled equalizer-shaped difference signal;

a second signal adder, receiving as two inputs the dynamic-gain-controlled equalizer-shaped difference signal and the equalizer-shaped first stereo signal, configured and arranged to add the two received inputs and provide as output a first enhanced stereo signal; and a third signal adder, receiving as two inputs the inverted dynamic-gain-controlled equalizer-shaped difference signal and the equalizer-shaped second stereo signal, configured and arranged to add the two received inputs and provide as output a second enhanced stereo signal.

2. The stereo enhancement signal processor as defined in claim 1, further comprising:

a second gain controller, receiving as a signal input the first enhanced stereo signal and receiving as a control input the DC ratio-value signal, configured and arranged to provide as a output of said processing system a first gain-controlled enhanced stereo output signal;

a third gain controller, receiving as a signal input the second enhanced stereo signal and receiving as a control input the DC ratio-value signal, configured and arranged to provide as output of said processing system a second gain-controlled enhanced stereo output signal; and LEFT FRONT and RIGHT FRONT stereo output terminal means, receiving the first and second stereo output signals respectively from said second and third gain controllers, thus providing therefrom the first and second gain-controlled enhanced stereo output signals respectively as line-level output signals, whereby left front and right front stereo speakers of a surround stereo sound system respectively may be driven via a stereo amplifier.

3. The stereo enhancement signal processor as defined in claim 2, further comprising.

a low-pass filter, receiving as input the sum signal from said first signal adder, configured and arranged to provide as output a low-pass-filtered sum signal;

a fourth gain controller, receiving as a signal input the low-pass-filtered sum signal and receiving as a control input the DC ratio-value signal, configured and arranged to provide as output a gain-controlled low-pass-filtered sum signal;

a third input node provided in said second signal adder, receiving as input the gain-controlled low-pass-filtered sum signal from said fourth gain controller, whereby the sum signal output from said second signal adder is made to represent a sum of the signals received at the three input nodes thereof;

a third input node provided in said third signal adder, receiving as input the gain-controlled low-pass-filtered sum signal from said fourth gain controller, whereby the sum signal output from said third signal adder is made to represent a sum of the signals received at the three input nodes thereof.

4. The stereo enhancement signal processor as defined in claim 3, further comprising SUBWOOFER output terminal means, receiving input from said fourth gain controller, configured and arranged to provide the gain-controlled low-pass-filtered sum signal as a line-level output signal whereby a subwoofer loudspeaker may be driven via an associated power amplifier.

5. The stereo enhancement signal processor as defined in claim 3 further comprising;

a fifth gain controller, receiving as a signal input the low-pass-filtered sum signal from said low-pass filter and receiving as a control input the DC ratio-value signal, configured and arranged to provide as output a gain--controlled low-pass-filtered sum signal; and SUBWOOFER output terminal means, receiving input from said fifth gain controller, configured and arranged to provide the gain-controlled low-pass-filtered sum signal as a line-level output signal, whereby a subwoofer loudspeaker may be driven via an associated power amplifier.

6. The stereo enhancement signal processor as defined in claim 5 further comprising CENTER-FRONT output terminal means, receiving input from said first signal adder, configured and arranged to provide the sum signal therefrom as a line-level output signal whereby a center-front-located loudspeaker may be driven via an associated amplifier.

7. The stereo enhancement signal processor as defined in claim 1, further comprising:

a fourth shaping equalizer, receiving as input the difference signal, configured and arranged to provide as output a second equalizer-shaped difference signal;

a second gain controller, receiving as signal input the second equalizer-shaped difference signal from said fourth shaping equalizer and receiving as a control input the DC ratio-value signal from the ratio detector, configured and arranged to provide as output a gain-controlled equalizer-shaped difference signal;

a second phase inverter, receiving as input the gain-controlled equalizer-shaped difference signal from said second gain controller, configured and arranged to invert the received input and provide therefrom an inverted gain-controlled equalizer-shaped difference signal;

LEFT-REAR and RIGHT-REAR output terminal means, receiving input from said second gain controller and said second phase inverter respectively, configured and arranged to provide, as line-level output signals, the gain-controlled equalizer-shaped difference signal and the inverted gain-controlled equalizer-shaped difference signal, whereby a left-rear-located loudspeaker and a right-rear-located loudspeaker may be driven via corresponding associated amplifiers for producing surround sound.

8. The stereo enhancement signal processor as defined in claim 7, further comprising:

a third gain controller, receiving as a signal input the enhanced first stereo signal from said second signal adder and receiving as a control input the DC ratio-value signal, configured and arranged to provide as output of said processing system a first gain-controlled enhanced stereo output signal;

a fourth gain controller, receiving as a signal input the enhanced second stereo signal and receiving as a control input the DC ratio-value signal, configured and arranged to provide as output of said processing system a second gain-controlled enhanced stereo output signal; and LEFT FRONT and RIGHT FRONT stereo output terminal means, receiving the first and second stereo output signals respectively thus providing therefrom the first and second gain-controlled enhanced stereo output signals as line-level output signals whereby left front and right front stereo speakers of a surround stereo sound system may be driven via a stereo amplifier.

9. The stereo enhancement signal processor as defined in claim 8, further comprising;

a low-pass filter, receiving as input the sum signal from said first signal adder, configured and arranged to provide as output a low-pass-filtered sum signal;

a fifth gain controller, receiving as a signal input the low-pass-filtered sum signal and receiving as a control input the DC ratio-value signal, configured and arranged to provide as output a gain-controlled low-pass-filtered sum signal; and a third input node provided in said second signal adder, receiving as input the gain-controlled low-pass-filtered sum signal from said fifth gain controller, whereby the sum signal output from said second signal adder is made to represent a sum of the signals received at the three input nodes thereof; and a third input node provided in said third signal adder, receiving as input the gain-controlled low-pass-filtered sum signal from said fifth gain controller, whereby the sum signal output from said third signal adder is made to represent a sum of the signals received at the three input nodes thereof.

10. The stereo enhancement signal processor as defined in claim 9 further comprising CENTER-FRONT output terminal means receiving as input the sum signal from said first signal adder, configured and arranged to provide therefrom a line-level output signal representing the sum signal, whereby a center-front-located loudspeaker may be driven via an associated amplifier.

11. The stereo enhancement signal processor as defined in claim 10, further comprising SUBWOOFER output terminal means, receiving input from said fifth gain controller, configured and arranged to provide therefrom the gain-controlled low-pass-filtered sum signal as a line-level output signal, whereby a subwoofer loudspeaker may be driven via an associated power amplifier.

12. The stereo enhancement signal processor as defined in claim 10, further comprising:

a sixth gain controller, receiving as a signal input the low-pass-filtered sum signal and receiving as a control input the DC ratio-value signal, configured and arranged to provide as output a gain-controlled low-pass-filtered sum signal; and SUBWOOFER output terminal means, receiving input from said sixth gain controller, configured and arranged to provide therefrom the gain-controlled low-pass-filtered sum signal as a line-level output signal, whereby a subwoofer loudspeaker may be driven via an associated power amplifier.

13. An audio stereo signal enhancement process performed in a stereo processor interposed in a stereo sound system between a stereo signal source providing a stereo signal pair and a stereophonic amplifier that drives stereo loudspeakers, said signal enhancement process comprising the steps of:

(a) subtracting a first signal of the stereo signal pair from a second signal thereof in a signal subtractor so as to derive as output a difference signal;

(b) adding the first and second signals of the stereo signal pair so as to derive a sum signal;

(c) equalizer-shaping the first signal of the stereo signal pair so to provide as output a first equalizer-shaped stereo signal;

(d) equalizer-shaping the second signal of the stereo signal pair to provide as output a second equalizer-shaped stereo signal;

(e) peak-detecting the difference signal from step (a) so as to provide a peak-detected DC difference signal;

(f) peak-detecting the sum signal from step (b) so as to provide a peak-detected DC sum signal;

(g) deriving a DC ratio-value signal representing an amplitude ratio between the peak-detected DC difference signal and the peak-detected DC sum signal;

(h) equalizer-shaping the difference signal from step (a) so as to provide an equalizer-shaped difference signal;

(i) gain-controlling the equalizer-shaped difference signal as a function of the DC ratio-value signal from step (g) so as to provide a dynamic-gain-controlled equalizer-shaped difference signal; (j) phase inverting the dynamic-gain-controlled equalizer-shaped difference signal so as to provide therefrom an inverted dynamic-gain-controlled equalizer-shaped difference signal; (k) summing the dynamic-gain-controlled equalizer-shaped difference signal from step (i) and first equalizer-shaped stereo signal from step (c) so as to provide as output of said signal enhancement process a first enhanced stereo output signal; and (l) summing the inverted dynamic-gain-controlled equalizer-shaped difference signal from step (j) and the second equalizer-shaped stereo signal from step (d) so as to provide as output of said signal enhancement process a second enhanced stereo output signal.

14. The audio stereo signal enhancement process as defined in claim 13 further comprising the additional steps of:

(m) gain-controlling the first enhanced stereo output signal from step (k) as a function of the DC ratio-value signal from step (g) so as to provide a first gain-controlled enhanced stereo output signal; and (n) gain-controlling the second enhanced stereo output signal from step (l) as a function of the DC ratio-value signal from step (g) so as to provide, as output of said signal enhancement process, a second gain-controlled enhanced stereo output signal.

15. The audio stereo signal enhancement process as defined in claim 14 further comprising the additional steps of:

(o) low-pass filtering the sum signal from step (b) so as to provide a filtered sum signal;

(p) gain-controlling the filtered sum signal as a function of the DC ratio-value signal from step (g) so as to provide a gain-controlled filtered sum signal:

(q) summing the gain-controlled filtered sum signal along with the signals from steps (i) and (c) being summed in step (k) so as to add dynamically-processed common-mode low-frequency components to the first gain-controlled enhanced stereo output signal of the processor for optimizing overall low-frequency performance; and (r) summing the gain-controlled filtered sum signal from step (p) along with the signals from steps (j) and (d) being summed in step (l) so as to add dynamically-processed low-frequency components to the second gain-controlled enhanced stereo output signal of the processor for optimizing overall low-frequency performance.

16. An audio stereo signal enhancement process performed in a surround/stereo processor interposed in a surround/stereo sound system between a stereo signal source providing a stereo signal pair and surround/stereophonic amplification means driving surround/stereo loudspeakers, said signal enhancement process comprising the steps of:

(a) subtracting a first signal of the stereo signal pair from a second signal thereof in a signal subtractor so as to derive as output a difference signal;

(b) adding the first and second signals of the stereo signal pair so as to derive a sum signal;

(c) equalizer-shaping the first signal of the stereo signal pair so to provide as output a first equalizer-shaped stereo signal; (d) equalizer-shaping the second signal of the stereo signal pair to provide as output a second equalizer-shaped stereo signal;

(e) peak-detecting the difference signal from step (a) so as to provide a peak-detected DC difference signal;

(f) peak-detecting the sum signal from step (b) so as to provide a peak-detected DC sum signal;

(g) deriving a DC ratio-value signal representing an amplitude ratio between the peak-detected DC difference signal and the peak-detected DC sum signal;

(h) equalizer-shaping the difference signal from step (a) so as to provide an equalizer-shaped difference signal;

(i) gain-controlling the equalizer-shaped difference signal as a function of the DC ratio-value signal from step (g) so as to provide a dynamic-gain-controlled equalizer-shaped difference signal;

(j) phase inverting the dynamic-gain-controlled equalizer-shaped difference signal so as to provide therefrom an inverted dynamic-gain-controlled equalizer-shaped difference signal;

(k) summing the dynamic-gain-controlled equalizer-shaped difference signal from step (i) and first equalizer-shaped stereo signal from step (c) so as to provide, as output of said signal processor, a first enhanced stereo output signal;

(l) summing the inverted dynamic-gain-controlled equalizer-shaped difference signal from step (j) and the second equalizer-shaped stereo signal from step (d) so as to provide, as output of said signal processor, a second enhanced stereo output signal;

(m) equalizer-shaping the difference signal from step (a) in a manner to provide a second equalizer-shaped difference signal;

(n) gain-controlling the second equalizer-shaped difference signal as a function of the DC ratio-value signal from step (g) so as to provide a second gain-controlled equalizer-shaped difference signal;

(o) phase-inverting second gain-controlled equalizer-shaped difference signal so as to provide a second inverted gain-controlled equalizer-shaped difference signal;

(p) driving left-rear and right-rear loudspeaker units of the surround sound system via associated power amplifiers receiving as input the second gain-controlled equalizer-shaped difference signal from step (n) and the second inverted gain-controlled equalizer-shaped difference signal from step (o), respectively.

17. The audio stereo signal enhancement process as defined in claim 16 further comprising the additional step of:

(q) gain-controlling the first and second enhanced stereo output signal from steps (k) and (l) as a function of the DC ratio-value signal from step (g) so as to provide a first and a second gain-controlled enhanced stereo output signal as main output signals of said stereo processor.

18. The audio stereo signal enhancement process as defined in claim 17, further optimized with respect to overall low-frequency performance, further comprising the additional steps of:

(r) low-pass filtering the sum signal from step (b) so as to provide a filtered sum signal;

(s) gain-controlling the filtered sum signal as a function of the DC ratio-value signal from step (g) so as to provide a gain-controlled filtered sum signal:

(t) summing the gain-controlled filtered sum signal along with the signals from steps (i) and (c) being summed in step (k) so as to add dynamically processed low-frequency components to the first enhanced stereo output signal of the processor; and (u) summing the gain-controlled filtered sum signal from step (s) along with the signals from steps (j) and (d) being summed in step (l) so as to add dynamically-processed low-frequency components to the second enhanced stereo output signal of the processor.

19. The audio stereo signal enhancement process as defined in claim 18 further comprising the additional step of:

(v) gain-controlling the filtered sum signal from step (r) as a function of the DC ratio-value signal from step (g) so as to provide a second gain-controlled filtered sum signal for utilization as a line-level SUBWOOFER output signal.

* * * * *